US005297673A

United States Patent [19]

Sutherland

[11] Patent Number: 5,297,673

[45] Date of Patent: Mar. 29, 1994

[54] WRAP-AROUND CARRIER WITH END PANELS

[75] Inventor: Robert L. Sutherland, Kennesaw, Ga.

[73] Assignee: Riverwood International Corporation, Atlanta, Ga.

[21] Appl. No.: 61,880

[22] Filed: May 17, 1993

[51] Int. Cl.[5] ..... B65D 75/08

[52] U.S. Cl. ..... 206/147; 206/155; 206/427

[58] Field of Search ..... 206/427, 435, 139, 140, 206/141, 142, 143, 144, 145, 146, 147, 148, 151, 152, 155, 156, 160, 161, 200

[56] References Cited

U.S. PATENT DOCUMENTS 3,306,519 2/1967 Wood ..... 206/140 X
3,670,950 6/1972 Rossi ..... 206/140 X
3,679,121 7/1972 Morgese ..... 206/155 X
4,190,149 2/1980 Oliff et al. ..... 206/147 X
4,328,893 5/1982 Oliff et al. ..... 206/140 X

*Primary Examiner*—Paul T. Sewell
*Assistant Examiner*—Jacob K. Ackun, Jr.

[57] ABSTRACT

A wrap-around carrier with end panel flaps that automatically close when the bottom panel flaps are set up for locking engagement. The end panel flaps are foldably connected to the side panels and to gusset panels which are also foldably connected to a bottom panel flap. Upon folding the gusset panels into engagement with the adjacent bottom panel flap, the end panel flaps are folded into closed position. The folded gusset panels are located between the bottoms of the packaged articles and the bottom panel, thereby locking the end panel flaps in closed position.

4 Claims, 3 Drawing Sheets

FIG. 1
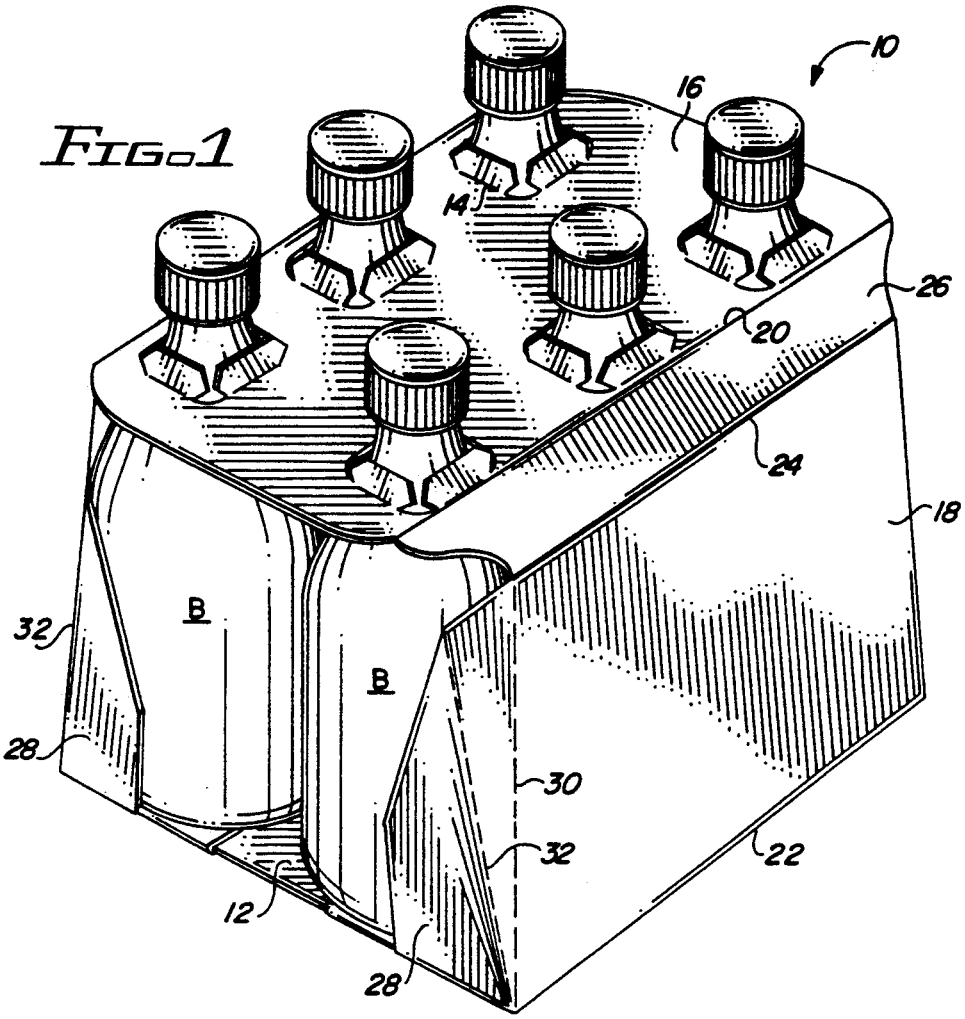
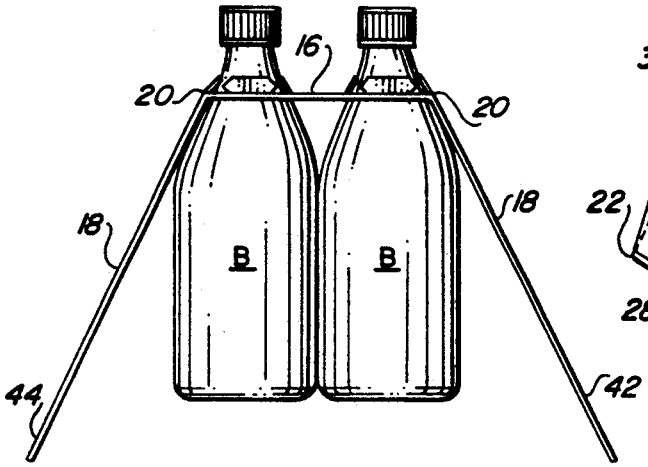
FIG. 3
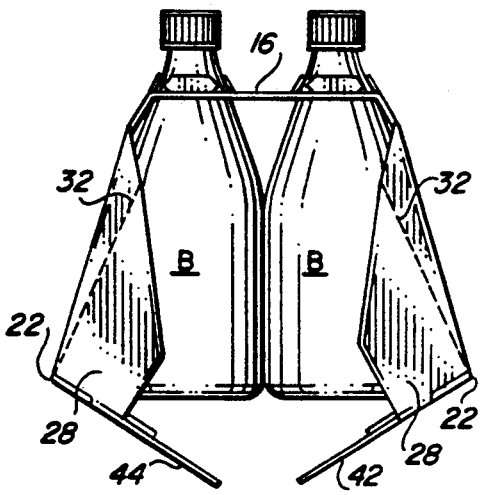
FIG. 4

WARP-AROUND CARRIER WITH END PANELS

FIELD OF THE INVENTION

This invention relates to wrap-around carriers, and more particularly to wrap-around carriers having end panels.

BACKGROUND OF THE INVENTION

Wrap-around carriers provide a relatively inexpensive but effective means for packaging articles, requiring blanks of only minimum size which are capable of running on packaging machines at high speeds. A wrap around carrier is formed by first grouping the articles to be packaged in the same arrangement they will have in the package, then wrapping a carrier blank around the articles and securing the ends of the blank together. By tightly wrapping the articles, and also by having the bottom portions of the articles protrude through openings in the side panels of the carrier, the articles are contained in the carrier and prevented from falling out through the open ends. For example, cutouts in the side panels are employed to receive the flanges of cans and other flanged articles while heel cutouts in the lower portions of the side panels are employed to receive the heels or bases of bottles.

While such measures have been successful in containing bottles of traditional design in their wrap-around carriers, new bottle designs do not always lend themselves to conventional treatment. The trend to larger beverage bottles makes it incumbent to employ carriers that are not only structurally capable of supporting heavier loads but are able to positively prevent outward movement of the end bottles. This becomes more difficult when the bottle design is such that it no longer includes a conventionally shaped heel which normally would be held in place by a heel cutout. The packaging of bottles provided with petaloid bottom designs is particularly difficult in this respect.

It would be desirable to be able to employ wrap-around carriers to package bottles and other articles whose design makes it difficult or impossible to be held in place by side panel cutouts, and to do so without danger of the articles sliding out the ends of the carrier.

BRIEF SUMMARY OF THE INVENTION

The wrap-around carrier of the invention is comprised of side panels foldably connected to a top panel and to bottom panel flaps as is well known in the art. In addition, each side panel is connected along an end fold line to an end panel flap, which is also foldably connected along its lower edge to a gusset panel. Each gusset panel is foldably connected to an adjacent end edge of an associated bottom panel flap. The gusset panels include an intermediate diagonal fold line which divides them into a first portion extending between the intermediate fold line and the connection to the adjacent end panel flap and a second portion extending between the intermediate fold line and the connection to the adjacent bottom panel flap.

Each gusset panel is folded about its intermediate fold line and about the fold line connecting it to the bottom panel flap so that one face of the second portion of the gusset panel is in contact with the bottom panel and the opposite face of the second portion is in contact with the first gusset panel portion. As a result of this arrangement, packaged articles adjacent the end panel flaps rest on the first and second portions of the gusset panels.

This holds the end panel flaps in place, which enables the end panel flaps to restrain the articles against movement out the ends of the carrier. The carrier is simple to set up, as the folding of the gusset panels causes the end panel flaps to automatically move into closed position upon movement of the bottom panel flaps into locking position.

The invention may be employed in carriers used in packaging conventionally shaped bottles and cans, but is especially useful when packaging articles that do not lend themselves to being retained by the usual heel cutouts in wrap-around carriers. A beverage bottle formed with a petaloid design is an example of an article that is not suitably restrained against movement by side panel cutouts.

In addition, the invention provides end panel flaps which are capable of closely following the contour of rounded articles. This is brought about by connecting the end panel flaps to the side panels along an outwardly angled fold line. Preferably, the end panel flaps are made to fold about adjacent rounded articles by providing an intermediate fold line which meets with the fold line connecting the end panel flaps to the side panels.

The carrier provides greater structural integrity than carriers employing cutouts, yet requires only a minimum of stock. Set-up of the carriers is simple and rapid, permitting the packaging machine to run at high speeds.

The above and other aspects and benefits of the invention will readily be apparent from the more detailed description of the preferred embodiment of the invention which follows.

BRIEF DESCRIPTION OF THE DRAWING

FIG. 1 is a pictorial view of the carrier of the invention;

FIG. 3 is an end view of the blank in an initial stage of carrier formation after being placed over a group of bottles and initially folded;

FIG. 4 is an end view similar to that of FIG. 3, but showing the blank in the process of being folded into bottom panel locking position;

DETAILED DESCRIPTION OF THE PREFERRED EMBODIMENT

Figure 2:
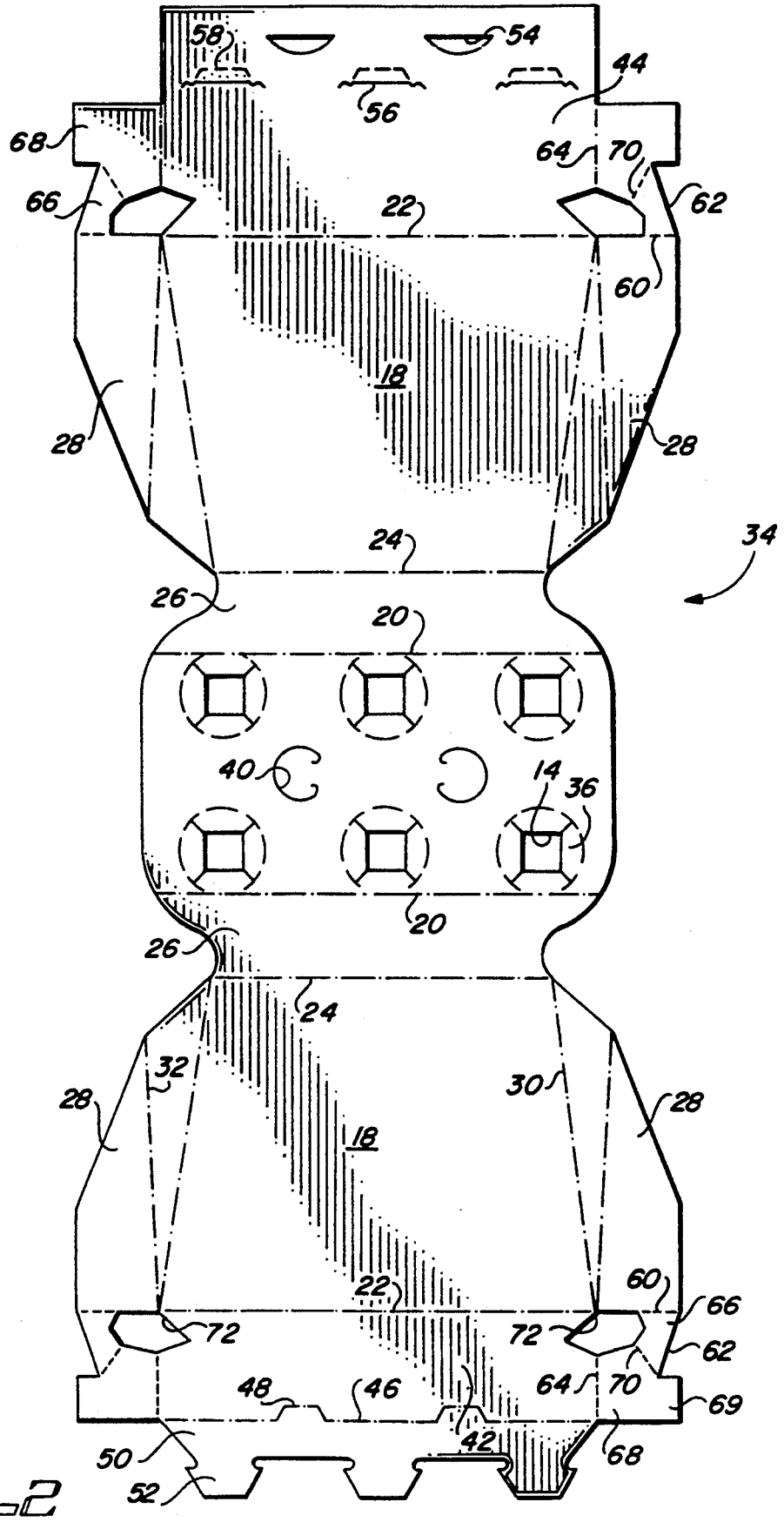
FIG. 2 is a plan view of a blank used to form the carrier.

Referring to FIG. 1, the wrap-around carrier 10 is illustrated as a package containing six beverage bottles B supported on bottom panel 12 and extending up through neck openings 14 in top panel 16. Side panels 18 are connected to the top panel along fold lines 20 and to the bottom panel along fold lines 22. Fold lines 24, which are parallel to and spaced a short distance from the fold lines 20, form a smaller sloped panel portion 26 within the side panels 18. The sloped panel portion contacts the sloped portions of the bottles between the neck and barrel to hold the bottles securely in this area.

End panel flaps 28 are connected to the side panels along fold lines 30, and are also foldably connected to gusset panels which are not visible in this view. Preferably, the fold lines 30 extend outwardly from the vertical and the end panel flaps include an intermediate fold line 32. Both of these design features facilitate the wrapping or folding of the end panel flaps around the adjacent curved barrel portions of the bottles B.

Referring now to FIG. 2, wherein like reference numerals to those used in FIG. 1 denote like elements, a blank 34 capable of being fabricated into the carrier of FIG. 1 is comprised of a central top panel section 16 connected at opposite sides by fold lines 20 to the sloped side panel sections 26. The top panel section includes the openings 14 which are surrounded by foldably connected tabs 36 for receiving the necks of bottles packaged in the carrier. Finger holes formed by slits 40, or any other suitable handle, may be provided for lifting the carrier. If the articles to be packaged do not have necks or are otherwise shaped so as not to extend through the top panel, the openings 14 would not be provided.

The fold lines 22 connect the side panels to bottom panel flaps 42 and 44. The bottom panel flap 42 includes a fold line 46 which extends the full length of the flap and which is interrupted by primary male locking tabs 48. The portion 50 of the flap 42 lying outwardly of the fold line 46 constitutes a locking panel which includes secondary male locking tabs 52. The bottom panel flap 44 includes primary female locking edges 54 adapted to engage the primary male locking members 48 and slits 56 adapted to receive the secondary locking tabs 52. Tabs 58 are foldably connected to the bottom panel flap 44 a short distance outwardly of the slits 56 to facilitate entry of the locking tabs 52 into the slits. These various locking elements are illustrated to demonstrate a typical bottom panel locking arrangement suitable for use with the carrier of the invention, but it should be understood that any desired effective form of bottom panel locking means may be employed.

Still referring to FIG. 2, the end panel flaps 28 connected to the fold lines 30 terminate at their lower ends in a fold line 60 which is an extension of the fold line 22. Connected to the fold lines 60 are gusset panels 62, which are also connected by fold lines 64 to the bottom panel flaps 42 and 44. The fold lines 60 and 64, if extended, would converge at the intersection of the fold lines 22 and 30. A diagonal fold line 70 divides the gusset panels 62 into a first portion or segment 66 and a second portion or segment 68, with the second gusset segment 68 including an extension or finger 69. A cutout 72 is provided along a part of the bottom of the side panel flaps 28 and into adjacent portions of the gusset panels and bottom panel flaps in order to facilitate the folding of the gusset panels and the adjacent flaps. The intermediate fold line 32 in the side panel flaps 28 can be seen to extend from a point on the upper edge of the flaps 28 to the intersection of the fold lines 22 and 30. As will be clear from the following description of the folding operations, the intersections of these fold lines correspond to the bottom corners of the carrier.

To form a package of bottles, the bottles are grouped together as they are to be arranged in the package and the top panel section of the blank is placed on top of them, with the necks of the bottles extending through the bottle neck openings 36, as illustrated in FIG. 3. The blank is shown as being in a preliminary interim condition, folded down about the fold lines 20, with the side panel sections, the gusset panels and the bottom panel sections still in the same planar relationship as in FIG. 2. The gusset panel segments 68 are then folded in about fold line 64 and held in place while the blank is folded along the fold lines 22 and the ends of the blank are moved toward each other into bottom panel locking position. The gusset panel fingers 69 of the segments 68 are engaged and moved by suitable packaging machine elements in order to fold the gusset panel into this position. Neither the packaging machine itself nor the folding elements of the machine have been shown since the various mechanical movements required in order to fold the panels of a carrier into place are well within the scope of one skilled in the packaging machine art.

Figure 5:
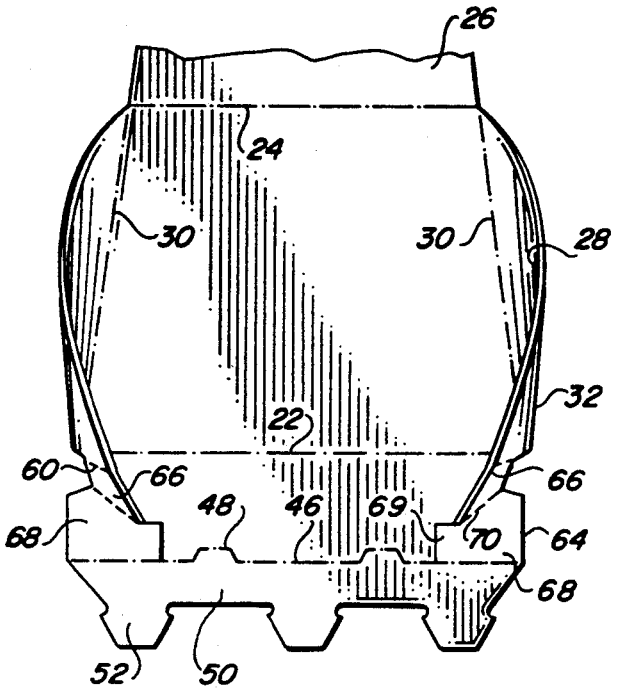
FIG. 5 is a side view of the interior face of one of the side panels and connected bottom panel flap of the carrier blank of FIG. 4, with the bottles omitted for the sake of clarity.

Referring back to FIG. 2, when the gusset panel segments 68 are folded about fold line 64 to bring the segments 68 into face-to-face contact with the bottom panel flaps 42 and 44, the gusset panel segment 66 moves with it, folding down about the intermediate fold line 70. The fold line connection 60 between the gusset panel segment 66 and the end panel flap 28 moves with the segment 66, causing the end panel flap 28 to pivot about the fold lines 30 and 32. The result of this initial action is shown in FIG. 5, wherein the gusset panel segments 66 overlie adjacent portions of the gusset panel segments 68 and at least the outer portions of the end panel flaps extend transversely of the bottom panel flaps, with the bottoms of the end panel flaps being substantially parallel to and aligned with the adjacent edge of the connected bottom panel flap. The appearance of the blank and bottles at this stage of formation is illustrated in FIG. 4.

The final step in the formation of the package is to lock the bottom panel flaps together. The details of this phase of the operation have not been illustrated since the particular locking mechanism employed does not form part of the invention. It will be understood by those familiar with the locking elements shown, however, that the outer flap portion or locking panel 50 of the bottom panel flap 42 is folded back about the fold line 46 and the primary male locking tabs 48 are engaged with the primary female locking edges 54 in bottom panel flap 44. The secondary male locking tabs 52 are then inserted through the slits 56 to complete the mechanical locking action, resulting in the package of FIG. 1. In connection with the operation of the secondary locking tabs 52 of the bottom flap 42, it can be seen in FIG. 2 that the gusset panel segment 68 connected to the flap 42 does not extend beyond the fold line 46. This allows the locking panel 50 to be folded during the locking procedure without interference from the gusset panel.

Figure 6:
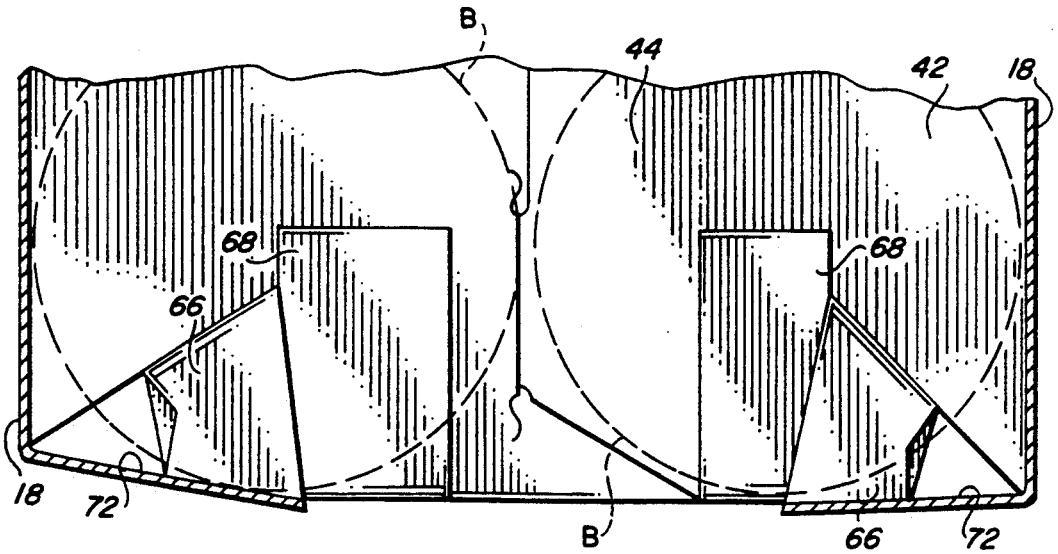
FIG. 6 is an enlarged sectional view of the carrier taken along a plane just above the bottom panel, showing the folded gusset panels in relation to the bottoms of packaged bottles.

When the bottom panel flaps are folded into position beneath the bottles, the folded gusset panel segments 66 and 68, which are then in face-to-face relationship, are moved up against the bottoms of the bottles. The position of the folded gusset panels with respect to the bottom panel and with respect to the bottles is illustrated in FIG. 6, with the location of the bottoms of the bottles indicated by the broken circles B. The locking tabs and female locking openings which normally would be visible have been omitted from this view for the sake of clarity. The end bottles can be seen to rest partially on the folded gusset panel segments. Because the end panel flaps are connected to the gusset panels, the end panel flaps are thereby locked in place, enabling them to restrain outward movement of the bottles. While the width of the gusset panel segments 68 is a matter of design preference, it must be wide enough to allow a significant area of the folded gusset panel to engage the bottom of a bottle without extending beyond the fold line 46.

It can be appreciated that the invention not only provides a carrier with end panel flaps for holding bottles in place instead of utilizing side panel heel cutouts, but employs a design which automatically closes the end panel flaps when the bottom panel flaps are moved into position to be locked together. The invention thus provides end panel restraints on a wrap-around carrier, which normally cannot be provided with end panels. In addition, the particular end panel flap design described permits the flaps to more closely follow the contours of curved packaged articles, which results in the articles being held more tightly in the package. Further, the absence of heel cutouts eliminates the danger of tearing in the side panels between the cutouts, making the side panels stronger and improving the structural integrity of the carrier.

It should now be apparent that the invention is not necessarily limited to all the specific details described in connection with the preferred embodiment, but that changes to certain features of the preferred embodiment which do not alter the overall basic function and concept of the invention may be made without departing from the spirit and scope of the invention as defined in the appended claims.

What is claimed is:

1. A package comprised of a wrap-around carrier containing a plurality of articles, comprising:

opposite side panels, each side panel being connected along an upper fold line to a top panel and along a lower fold line to a bottom panel flap, the bottom panel flaps being connected to each other to form the bottom panel of the carrier;

each side panel being connected along a fold line at each end thereof to an end panel flap;

each end panel flap being connected along a first fold line at a lower end edge thereof to a gusset panel;

each gusset panel being connected along a second fold line to an adjacent end edge of an associated bottom panel flap;

each gusset panel having an intermediate diagonal fold line dividing the gusset panel into a first portion extending between the intermediate fold line and said first fold line and a second portion extending between the intermediate fold line and said second fold line;

each gusset panel including an opening defined by interior edges of the first and second portions of the gusset panel, a portion of said lower end edge of the associated end panel flap and a portion of the adjacent end edge of the associated bottom panel flap, the intermediate diagonal fold line terminating at the opening;

the second portion of each gusset panel extending beyond the intermediate diagonal fold line of the gusset panel;

each gusset panel being folded about its intermediate fold line and second fold line so that one face of the second portion thereof is in contact with the bottom panel and the opposite face of the second portion is in contact with the first gusset panel portion, and;

bottom surfaces of packaged articles adjacent the end panel flaps resting separately on the first and second portions of the gusset panels to lock the gusset panels and end panels in place.

2. A wrap-around carrier as defined in claim 1, wherein:

the articles comprise beverage bottles having cylindrical body portions and sloped neck portions;

the fold lines connecting the end panel flaps to an associated side panel are more closely spaced apart at their upper ends than at their lower ends;

the end panel flaps include an intermediate fold line terminating at its lower end substantially at the intersection of the fold line connecting the side panels to the end panel flaps and the fold line connecting the side panels to the bottom panel flaps, said end panel intermediate fold line permitting the end panel flaps to more closely follow the contour of an adjacent rounded article;

the side panels are comprised of a main side panel body portion and an upper sloped portion connected thereto along a fold line; and the fold lines connecting the end panel flaps to the side panels are connected to the main side panel body portion and terminate at the fold line connecting the main side panel body portion to the upper sloped side panel portion.

3. A blank for forming a wrap-around carrier for packaging a plurality of articles, comprising:

a top panel section connected along fold lines at opposite side edges to a side panel section;

each side panel section being connected along a lower fold line to a bottom panel flap, the bottom panel flaps being adapted to be connected to each other to form the bottom panel of a carrier formed from the blank;

each side panel section being connected along a fold line at each end thereof to an end panel flap;

each end panel flap being connected along a first fold line at a lower end edge thereof to a gusset panel;

each gusset panel being connected along a second fold line to an adjacent end edge of an associated bottom panel flap;

each gusset panel having an intermediate diagonal fold line dividing the gusset panel into a first portion extending between the intermediate fold line and said first fold line and a second portion extending between the intermediate fold line and said second fold line;

each gusset panel including an opening defined by interior edges of the first and second portions of the gusset panel, a portion of said lower end edge of the associated end panel flap and a portion of the adjacent end edge of the associated bottom panel flap, the intermediate diagonal fold line terminating at the opening; and the second portion of each gusset panel extending beyond the intermediate diagonal fold line of the gusset panel;

whereby folding of each gusset panel about its intermediate fold line and second fold line results in one face of the second portion thereof being in contact with the bottom panel of a carrier formed from the blank and the opposite face of the second portion being in contact with the first gusset panel portion, enabling bottom surfaces of packaged articles adjacent the end panel flaps of a carrier formed from the blank to separately rest on the first and second portions of the gusset panels.

4. A wrap-around carrier blank as defined in claim 3, wherein:

the fold lines connecting the end panels flaps to an associated side panel section are spaced farther apart at the lower ends than at the opposite ends;

the end panel flaps include an intermediate fold line terminating substantially at the intersection of the fold line connecting the side panel sections to the end panel flaps and the fold line connecting the side panel sections to the bottom panel flaps, said end panel intermediate fold line permitting the end panel flaps to follow the contour of an adjacent rounded article in a carrier formed from the blank; and the side panel sections are comprised of a main side panel body portion and an upper portion connected thereto along a fold line, the upper portion forming a sloped side panel portion in a carrier formed from the blank in which necked bottles are packaged, the fold lines connecting the end panel flaps to the side panel sections being connected to the main side panel body portion and terminating at the fold line connecting the main side panel body portion to the upper side panel portion.

* * * * *